US008666648B2

(12) United States Patent
Shukla

(10) Patent No.: US 8,666,648 B2
(45) Date of Patent: Mar. 4, 2014

(54) SYSTEM AND METHOD FOR AIRCRAFT TAXING AND GUIDANCE USING A COMMUNICATION NETWORK

(75) Inventor: Vijay Shukla, Bangalore (IN)

(73) Assignee: Airbus Engineering Centre India, Bangalore, Karnataka (IN)

( * ) Notice: Subject to any disclaimer, the term of this patent is extended or adjusted under 35 U.S.C. 154(b) by 125 days.

(21) Appl. No.: 13/150,013

(22) Filed: Jun. 1, 2011

(65) Prior Publication Data

US 2011/0313645 A1 Dec. 22, 2011

(30) Foreign Application Priority Data

Jun. 16, 2010 (IN) ..... 1679/CHE/2010

(51) Int. Cl.
*G06G 7/76* (2006.01)

(52) U.S. Cl.
USPC ..... 701/120

(58) Field of Classification Search
USPC ..... 701/14–16, 120–122, 423, 431
See application file for complete search history.

(56) References Cited

U.S. PATENT DOCUMENTS

| | | | | |
|---|---|---|---|---|
| 7,099,752 | B1 * | 8/2006 | Lenell et al. | 701/2 |
| 7,813,845 | B2 * | 10/2010 | Doose et al. | 701/16 |
| 8,180,562 | B2 * | 5/2012 | Clark et al. | 701/446 |
| 8,229,604 | B2 * | 7/2012 | Villaume et al. | 701/3 |
| 8,264,378 | B1 * | 9/2012 | Martins et al. | 340/979 |
| 2003/0009278 | A1 * | 1/2003 | Mallet et al. | 701/120 |
| 2004/0059497 | A1 * | 3/2004 | Sankrithi | 701/120 |
| 2008/0109163 | A1 * | 5/2008 | Stone et al. | 701/211 |
| 2008/0211692 | A1 | 9/2008 | Fetzmann et al. | |
| 2009/0051570 | A1 * | 2/2009 | Clark et al. | 340/971 |
| 2010/0042312 | A1 * | 2/2010 | Meunier | 701/120 |
| 2011/0196599 | A1 * | 8/2011 | Feyereisen et al. | 701/120 |

FOREIGN PATENT DOCUMENTS

| | | | |
|---|---|---|---|
| WO | 03048888 | A2 | 6/2003 |
| WO | 03071228 | A2 | 8/2003 |

* cited by examiner

*Primary Examiner* — Mary Cheung
(74) *Attorney, Agent, or Firm* — Prakash Nama; Global IP Services, PLLC

(57) ABSTRACT

A system and method for aircraft taxiing and guidance using ground station's communication network is disclosed. In one embodiment, in a method of aircraft taxiing and guidance, a communication link between an aircraft computing system and a ground station system is established using a communication network provided by the ground station system. An aircraft taxi selection and guidance application residing in the aircraft computing system is displayed on a display device upon establishing the communication link. Further, one or more pilot selectable taxiing and ground services are displayed upon selecting the aircraft taxi selection and guidance application. One of the displayed pilot selectable taxiing and ground services is selected by a pilot of an aircraft. Information associated with the selected pilot selectable taxiing and ground service is then displayed on the display device using ground station data. The aircraft is taxied and guided by the pilot using displayed information.

13 Claims, 7 Drawing Sheets

300

400

SYSTEM AND METHOD FOR AIRCRAFT TAXING AND GUIDANCE USING A COMMUNICATION NETWORK

RELATED APPLICATIONS

Benefit is claimed under 35 U.S.C. 119(a)-(d) to Foreign application Serial No. 1679/CHE/2010 filed in INDIA entitled "SYSTEM AND METHOD FOR AIRCRAFT TAXIING AND GUIDANCE USING A COMMUNICATION NETWORK" by AIRBUS ENGINEERING CENTRE INDIA, filed on Jun. 16, 2010, which is herein incorporated in its entirety by reference for all purposes.

FIELD OF TECHNOLOGY

The present invention relates to the field of navigation of ground vehicles, more particularly, the present invention relates to a method of aircraft taxiing and guidance.

BACKGROUND

It is not just the safe and effective movement of aircraft during flight that has a role to play in the smooth handling of air traffic. Their movements on the ground are also of great importance in this regard. After landing, the aircraft must be moved from its landing position to a parked position which is commonly known as a gate. The task of the pilot is to move the aircraft quickly and safely to the gate notified to him by a control facility (e.g., a control center in an airport control tower or location). In such cases, the landing position and the parking position can be several kilometers away from each other.

Pilots in such cases sometimes have the problem after landing of not being immediately able to readily find their bearings. The reasons for this can, for example be, size of an airport, sudden change of a reference environment from extensive airspace to a comparatively narrow ground area of the airport, difficulties with visibility, and so on. In many cases, especially if flying into the airport for the first time, pilots may have vague information about where their intended parking position is located. In addition, radio frequencies of the ground control which give them such information may be heavily used and a pilot may need to wait for taxi clearance to the allocated gate. In some cases, the airport signs, on taxiways for example, may not be optimally standardized as yet.

The problem occurs especially if for reasons of weather or safety, for example the aircraft have to fly into alternate airports. Those piloting the aircraft may not be directly familiar with the layout on the ground at these airports since they might have rarely or never flown into them.

Further, a ground marshaller guiding an aircraft to halt at the gate using glowing sticks may be prone to erroneous signal or could lead to misrepresentation by the ground marshaller or misinterpretation by the pilot. This problem can intensify under poor weather conditions. Furthermore, pilot turning an aircraft to take it through a defined path could possibly overshoot or undershoot the path and can misguide the aircraft. Also, during an emergency landing situation, runway overruns or during insufficient braking conditions, the aircraft can cross a defined exit from a runway to the arrival gate. In such situations, the pilot has to rely on ad hoc ground navigation to navigate the aircraft from the runway until he sees the ground marshaller. In addition, pilot misidentification of gates can be time consuming that may lead to an aircraft coming in close proximity to other ground objects around the area. At some airports, ground traffic handling means in that careful sequencing of an aircraft in and out of gate areas is critical. A single aircraft out of place or sequence can affect the taxi clearances for many aircrafts waiting to depart or those waiting for gate clearance.

Thus, delays in movement of an aircraft on landing runways and taxiways and at other parking positions can have a negative effect on entire air and ground traffic at the airport. In many cases, such events can be responsible for contributing to the delays in arrivals and departures.

Currently, one approach requires the aircraft cockpit crew to carry aircraft maps with geographical details of the destination airport, diversion airports and airports along the flight path which can be flown in emergencies. The use of such maps can be time consuming as it requires that the pilot quickly transition from a highly automated navigation environment to a manual one. Then, the map view has to be reconciled with what the pilot can see from the aircraft, for example, landmarks or other features. Furthermore, if such maps are used, it is important that the maps are of current versions. For airports with frequent construction works and changing open and closed taxiways, this can present a problem.

Another approach requires a controller of the ground control to direct the pilot to a position provided using voice radio communication. In such cases, it should be taken into account that the radio frequencies on the ground and in the air may be heavily used to such an extent that there are programs which are aiming to reduce the traffic significantly.

Yet another approach requires using "visual guidance system," in which light sources (known as beacons) are let into a centerline of the taxiway to show the pilots their route to the parking position by means of trail of green lights. This approach can be expensive to implement and requires maintenance of the guidance pathways.

Yet another technique is based on navigation at an airport and in the surrounding airspace on global positioning system (GPS) navigation and satellite—assisted positioning, which are more complex to implement and does not address many of the above mentioned problems associated with the taxiing and guidance of an aircraft.

SUMMARY

A system and method for aircraft taxiing and guidance using a communication network is disclosed. According to one aspect of the invention, in a method of aircraft taxiing and guidance, a communication link between an aircraft computing system and a ground station system is established using a communication network provided by the ground station system. An aircraft taxi selection and guidance application residing in the aircraft computing system is displayed on a display device in an aircraft cockpit upon establishing the communication link.

Further, one or more pilot selectable taxiing and ground services are displayed upon selecting the aircraft taxi selection and guidance application. One of the displayed pilot selectable taxiing and ground services is selected by a pilot of an aircraft. Information associated with the selected one of the displayed pilot selectable taxiing and ground services is then displayed on the display device using ground station data residing in the ground station system via the communication link. The aircraft is then taxied and guided by the pilot using the displayed information.

According to another aspect of the present invention, in a method of aircraft taxiing and guidance, a communication link is established between an aircraft computing system and a ground station system using a communication network provided by the ground station system. One or more pilot selectable taxiing and ground services are displayed on a display device in an aircraft cockpit upon establishing the communication link using an aircraft taxi selection and guidance application residing in the aircraft computing system. The one or more pilot selectable taxiing and ground services includes taxiway services, connecting flight services, aircraft logbook services, pilot request services, and airport terminal information services and the like.

An array of pilot selectable and non-selectable gates associated with an airport is displayed on the display device using ground station data residing in the ground station system via the communication link upon selecting the taxiway services. Further, a gate is selected for parking from the displayed array of pilot selectable gates associated with the airport by a pilot of an aircraft. A runway map along with one or more paths is displayed on the display device using the ground station data residing in the ground station system via the communication link.

Further, the aircraft is taxied and guided from a landed position to the selected gate by the pilot using the displayed runway map along with the one or more paths. Furthermore, the pilot selected gate is placed in a standby lock mode. The pilot selected gate in the standby lock mode is displayed in a different contrast mode from the pilot selectable gates on the display device. The standby lock mode is replaced by a permanent lock mode when the aircraft is at a parking position associated with the pilot selected gate.

According to yet another aspect of the present invention, a non-transitory computer-readable storage medium for aircraft taxiing and guidance having instructions that, when executed by a computing device, cause the computing device to perform a method as described above.

According to a further another aspect of the present invention, a system for aircraft taxiing and guidance includes a processor, memory coupled to the processor and having an aircraft taxiing and guidance module, an aircraft computing system including a display device, a ground station system, and a communication network. The communication network establishes a communication link between the aircraft computing system and the ground station system. The communication network is provided by the ground station system.

The aircraft taxiing and guidance module has instructions capable of displaying an aircraft taxi selection and guidance application residing in the aircraft computing system on the display device upon establishing the communication link. The display device then displays one or more pilot selectable taxiing and ground services upon selecting the aircraft taxi selection and guidance application. Further, the display device displays information associated with a selected one of the displayed pilot selectable taxiing and ground services using ground station data residing in the ground station system via the communication link. Furthermore, the displayed information is used by the pilot for aircraft taxiing and guidance.

The methods, apparatuses, and systems disclosed herein may be implemented in any means for achieving various aspects. Other features will be apparent from the accompanying drawings and from the detailed description that follow.

BRIEF DESCRIPTION OF THE DRAWINGS

Various embodiments are described herein with reference to the drawings, wherein.

The drawings described herein are for illustration purposes only and are not intended to limit the scope of the present disclosure in any way.

DETAILED DESCRIPTION

A system and method for aircraft taxiing and guidance using a communication network is disclosed. In the following detailed description of the embodiments of the invention, reference is made to the accompanying drawings that form a part hereof, and in which are shown by way of illustration specific embodiments in which the invention may be practiced. These embodiments are described in sufficient detail to enable those skilled in the art to practice the invention, and it is to be understood that other embodiments may be utilized and that changes may be made without departing from the scope of the present invention. The following detailed description is, therefore, not to be taken in a limiting sense, and the scope of the present invention is defined by the appended claims.

Figure 1:
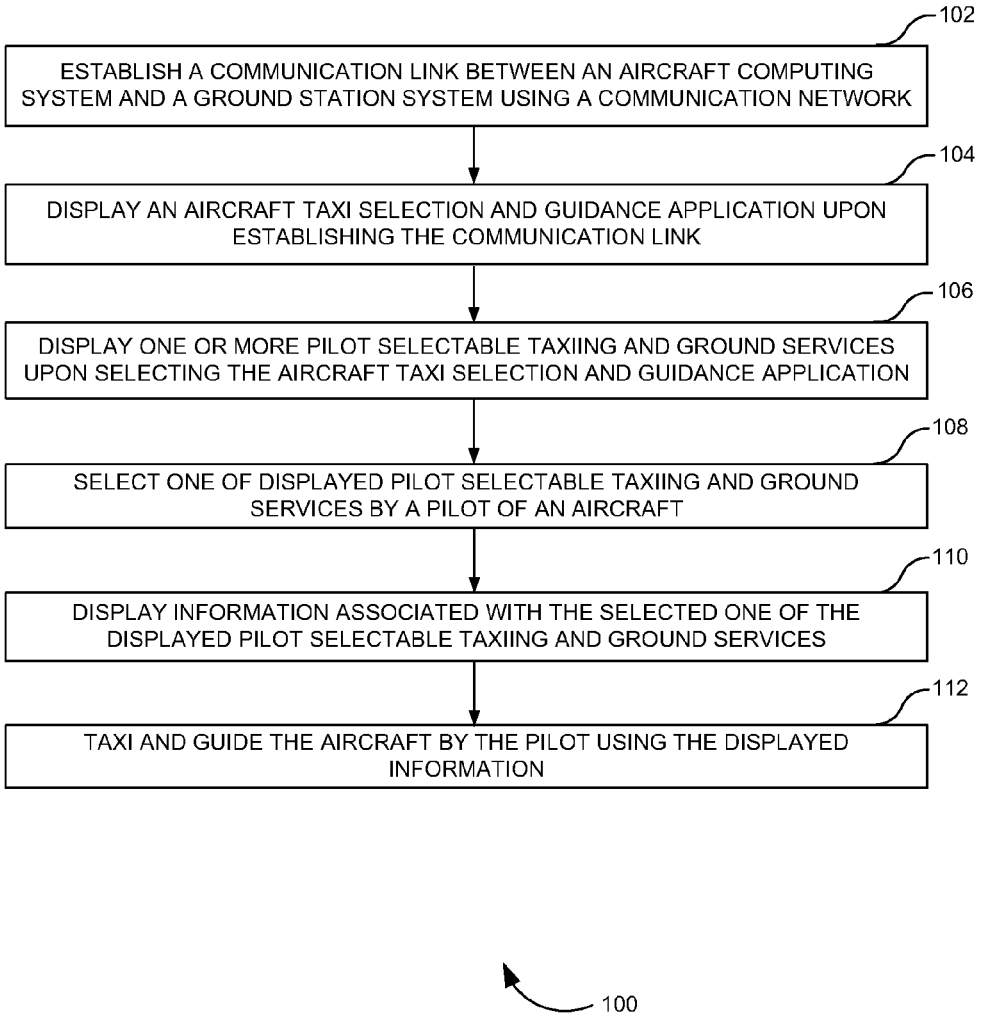
FIG. 1 illustrates a flow diagram of an exemplary method for aircraft taxiing and guidance, accordingly to one embodiment.

FIG. 1 illustrates a flow diagram of an exemplary method for aircraft taxiing and guidance, accordingly to one embodiment. At step 102, a communication link is established between an aircraft computing system and a ground station system when an aircraft is approaching substantially near a landing position. For example, the communication link is established using a communication network (e.g., WiMax) provided by the ground station system. The aircraft computing system may be a mobile computing system, an aircraft cockpit system, an aircraft navigation system, and the like.

Figure 2:
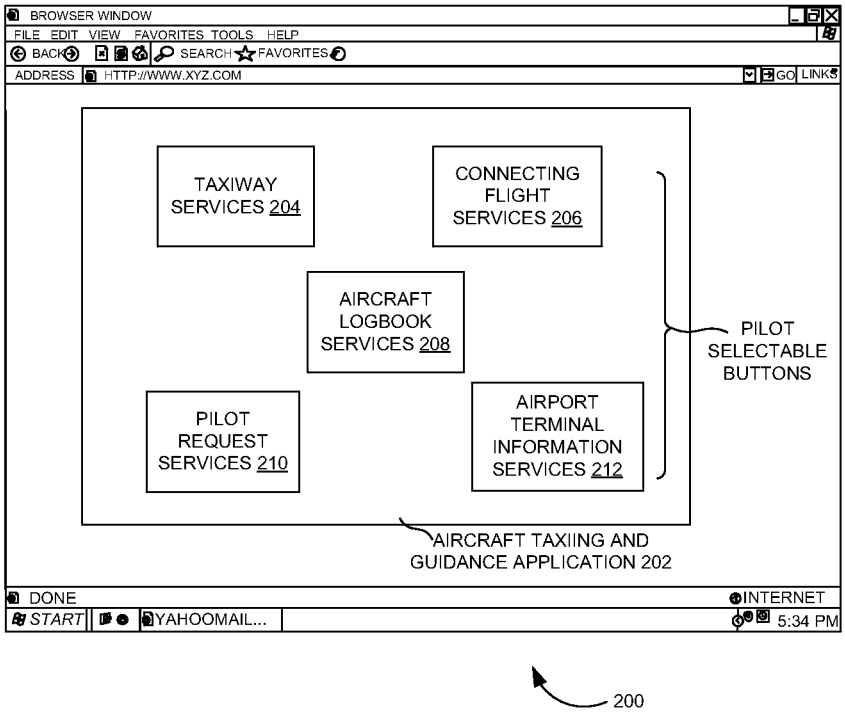
FIG. 2 illustrates a screenshot of an aircraft taxi selection and guidance application displaying pilot selectable taxiing and ground services, according to one embodiment.

At step 104, an aircraft taxi selection and guidance application (e.g., the aircraft taxi selection and guidance application 202 of FIG. 2) residing in the aircraft computing system is displayed on a display device (e.g., an interactive display) in an aircraft cockpit upon establishing the communication link. At step 106, one or more pilot selectable taxiing and ground services are displayed upon selecting the aircraft taxi selection and guidance application. The one or more pilot selectable taxiing and ground services may be taxiway services, connecting flight services, aircraft logbook services, pilot request services, and airport terminal information services.

At step 108, one of the displayed pilot selectable taxiing and ground services is selected by a pilot of an aircraft. At step 110, information associated with the selected one of the displayed pilot selectable taxiing and ground services is displayed on the display device using ground station data residing in the ground station system via the communication link. The ground station data may include taxiway data, connecting flight data, aircraft logbook data, pilot request form, aircraft terminal information data, and the like. For example, the pilot may select taxiway services from the displayed pilot selectable taxiing and ground services. When taxiway services are selected by the pilot, an array of pilot selectable and non-selectable gates associated with an airport is displayed on the display device. The pilot may select one of the displayed pilot selectable gates for parking the aircraft. When the gate is selected for parking, a runway map along with one or more paths is displayed on the display device.

Figure 3:
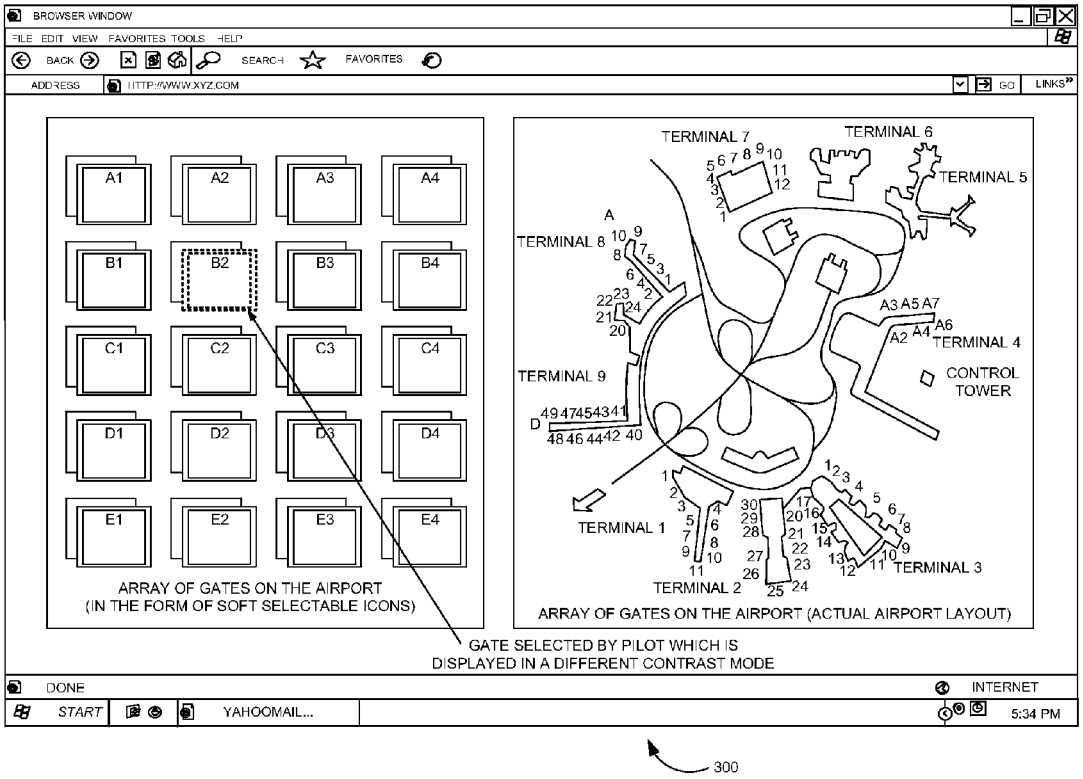
FIG. 3 illustrates a screenshot displaying an array of gates associated with an airport in the form of soft selectable icons and actual airport gate layout, accordingly to one embodiment.

At step 112, the aircraft is taxied and guided from a landed position to the selected gate by the pilot using the displayed information. In one exemplary implementation, the pilot selected gate is placed in a standby lock mode. Further, the pilot selected gate in the standby lock mode is displayed in a different contrast mode from the pilot selectable gates (e.g., as shown in FIG. 3). When the aircraft is at a parking position associated with the pilot selected gate, the standby lock mode is replaced by a permanent lock mode.

In addition, the pilot selected gates placed in the standby lock mode and the permanent lock mode are displayed as non-selectable gates on the display device of all other aircrafts. In another exemplary implementation, while selecting the gate for parking, the pilot may consider connecting flight data associated with the airport. The connecting flight data may be displayed on the display device when the pilot selects connecting flight services from the displayed pilot selectable taxiing and ground services.

FIG. 2 illustrates a screenshot 200 of an aircraft taxi selection and guidance application 202 displaying pilot selectable taxiing and ground services, according to one embodiment. In one embodiment, when an aircraft approaches substantially near a landing position and when a communication link is established with a ground base system, the aircraft taxi selection and guidance application 202 is displayed on a display device of an aircraft computing system associated with the aircraft. The display device may be a dedicated display device or may be display devices associated with a flight management system (FMS), an electronic flight bag (EFB), etc. associated with an aircraft cockpit. The pilot selectable taxiing and ground services are displayed in the form of pilot selectable buttons in the aircraft taxi selection and guidance application 202.

As illustrated in FIG. 2, the pilot selectable taxiing and ground services includes taxiway services 204, connecting flight services 206, aircraft logbook services 208, pilot request services 210, and airport terminal information services 212. When the pilot selects one of the displayed pilot selectable taxiing and ground services, information associated with the selected pilot selectable taxiing and ground service is displayed on the display device.

For example, information associated with the taxiway services 204 may include position data of all exits from the landing position, actual path information to follow to reach the selected gate from the landing position, alternate path information in case of non-feasibility of the actual path, etc. The information associated with the connecting flight services 206 may include information about different aircrafts and their schedule information, relevant data associated with a particular flight such as gate of departure, time of departure, time of boarding, current status, aircraft final destination, time of arrival, etc.

The information associated with the aircraft logbook services 208 may include reports about problems and malfunctions encountered during a flight. For example, the pilot may enter the problems and malfunctions in an aircraft logbook during the flight, which is available for use by airport authorities when the communication link is established. The information associated with pilot request services 210 may include specific services requested by the pilot from airport authorities. The specific services may be requirement of a wheel chair for a passenger, support for luggage, re-fuelling request, conveyance from the gate to airport exit, etc. The information associated with the airport terminal information services 212 may include information such as airport current temperature and pressure, airport elevation, facility available around the gate or the airport, pilot and passenger useable information about the airport, etc.

FIG. 3 illustrates a screenshot 300 displaying an array of gates associated with an airport in the form of soft selectable icons and actual airport gate layout, accordingly to one embodiment. In one exemplary implementation, the screenshot 300 may be displayed on the display device when the pilot selects the taxiway services 204 from the aircraft taxi selection and guidance application 202 displayed in FIG. 2. The pilot selects a gate for parking the aircraft based on displayed gate information. The pilot may also consider connecting flight data, airport terminal information data, pilot request form, and aircraft logbook data while selecting the gate for parking the aircraft.

As shown in FIG. 3, the pilot selects gate B2. Once the gate B2 is selected, the pilot may place the selected gate B2 in a standby lock mode. The gate B2 in the standby lock mode is displayed in a different contrast mode from the pilot selectable gates in the screenshot 300. Further, when the aircraft is parked at the selected gate B2, the standby lock mode is replaced by a permanent lock mode. The gate placed in standby lock mode and permanent lock mode is displayed as non-selectable gate on the display device of all other aircrafts. In another exemplary embodiment, the gate B2 in the standby lock mode may be released and displayed as a pilot selectable gate in the screenshot 300 when the pilot selects another gate for parking.

Figure 4:
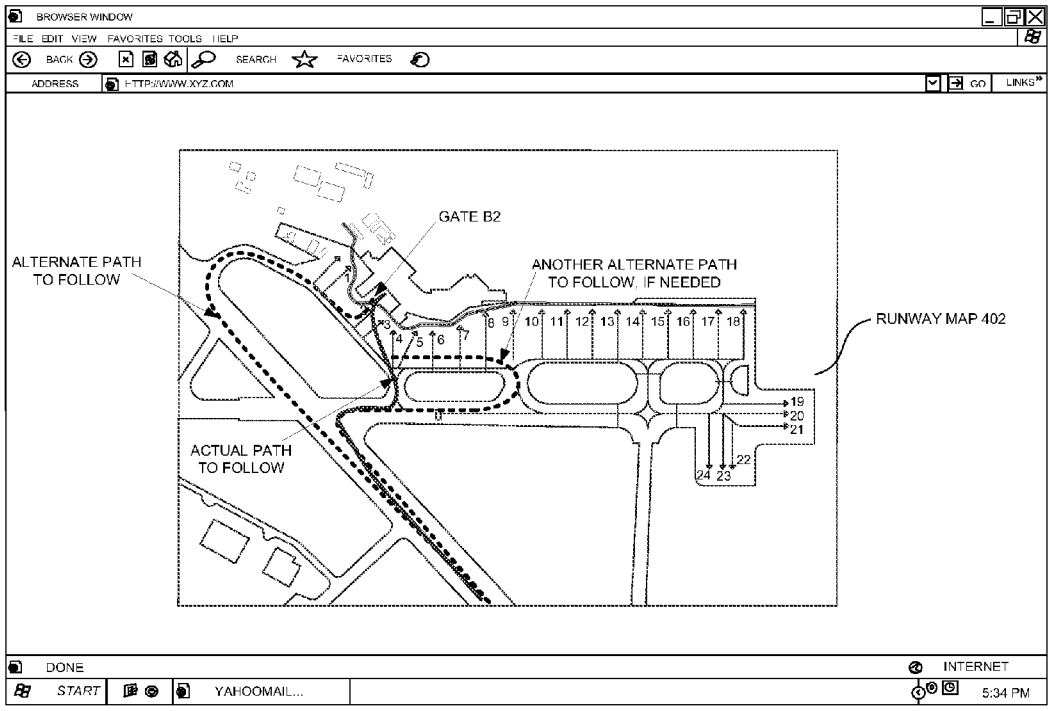
FIG. 4 illustrates a screenshot of a runway map showing path information to be taken by a pilot to reach a selected gate, according to one embodiment.

FIG. 4 illustrates a screenshot 400 of a runway map 402 showing path information to be taken by the pilot to reach the selected gate, according to one embodiment. The runway map 402 is generated when the pilot selects the gate B2 for parking the aircraft. In one embodiment, the runway map 402 is generated using the ground station data residing in the ground station system. The runway map 402 displays an actual path along with one or more alternate paths for the pilot to choose to reach the selected gate B2 from the landed position of the aircraft.

Figure 5:
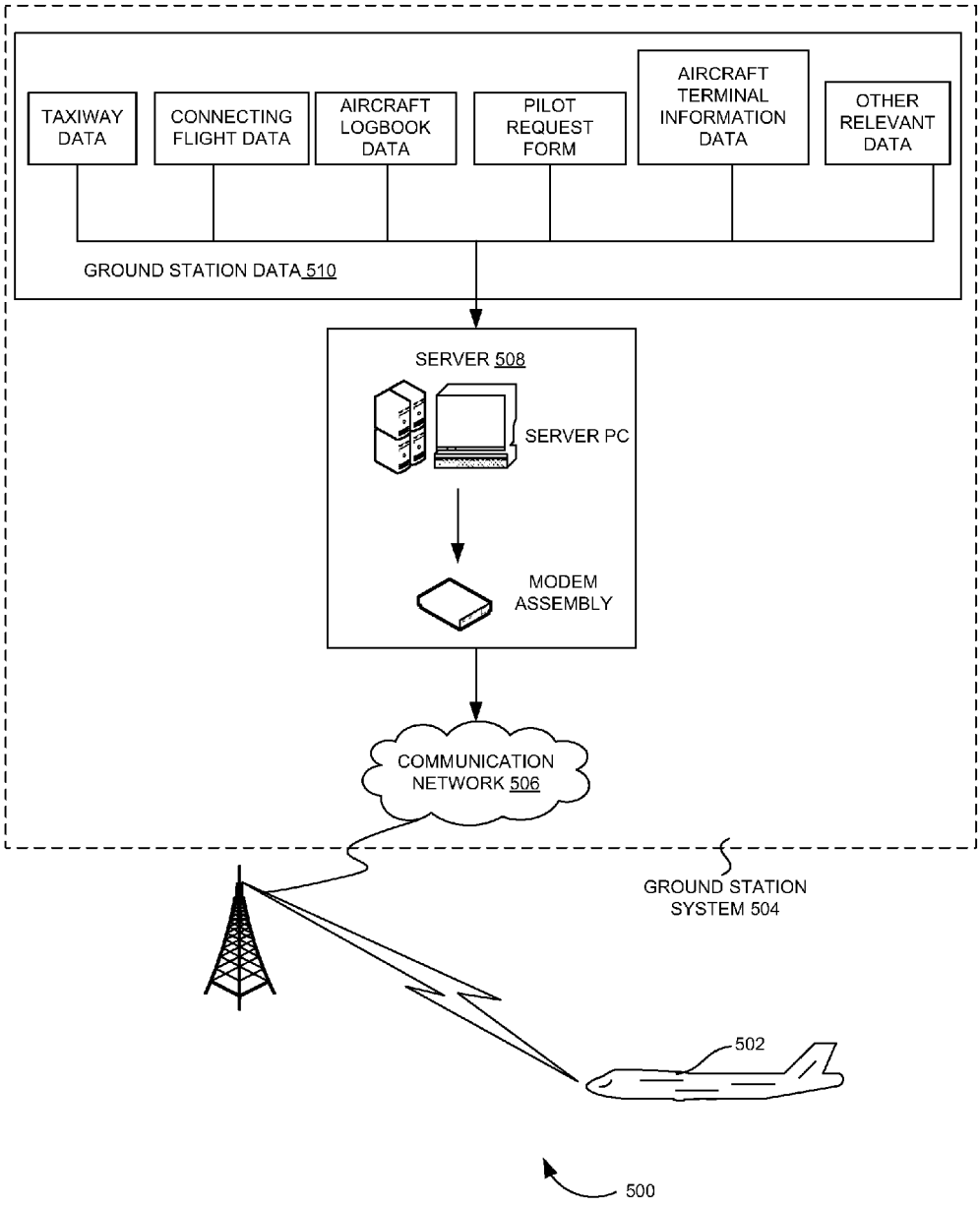
FIG. 5 illustrates an aircraft taxiing and guidance system, according to one embodiment.

FIG. 5 illustrates an aircraft taxiing and guidance system 500, according to one embodiment. As illustrated, the aircraft taxiing and guidance system 500 includes an aircraft 502 and a ground station system 504. The aircraft 502 includes an aircraft computing system (e.g., a mobile computing system, an aircraft cockpit system, an aircraft navigation system, etc.) having a display device. When the aircraft 502 is substantially in a landing position, a communication link is established between the aircraft computing system and the ground station system 504 using a communication network 506.

As shown in FIG. 5, the communication network is provided by the ground station system 504 and includes Wimax (e.g., 3.5 GHz radio frequency signal). When the communication link is established, the display device displays the aircraft taxi selection and guidance application 202 residing in the aircraft computing system. The pilot of the aircraft selects the aircraft taxi selection and guidance application 202 for selecting a taxiing and ground service (e.g., the taxiway services 204). The pilot selectable taxiing and ground services, and information associated with the pilot selectable taxiing and ground services are displayed on the display device as per pilot's selection. For example, when the taxiway services 204 are selected, pilot selectable gates are displayed on the display device. When the pilot selects a particular gate for parking, a route map (e.g., the route map 402 of FIG. 4) showing path information from current position of the aircraft 502 to the selected gate is displayed.

In one embodiment, the display device displays the information using ground station data 510 residing in the ground station system 504. The ground station data 510 includes taxiway data, connecting flight data, aircraft logbook data, pilot request form, airport terminal information data and other relevant data associated with the aircraft 502 and the ground station system 504. As illustrated, the ground station data 510 resides in a server 508 (which gets updated as and when a pilot selects a gate for parking an aircraft) in the ground station system 504. The server 508 also includes an airport map database populated with corresponding airport layout coordinates and parking gate locations.

Figure 6:
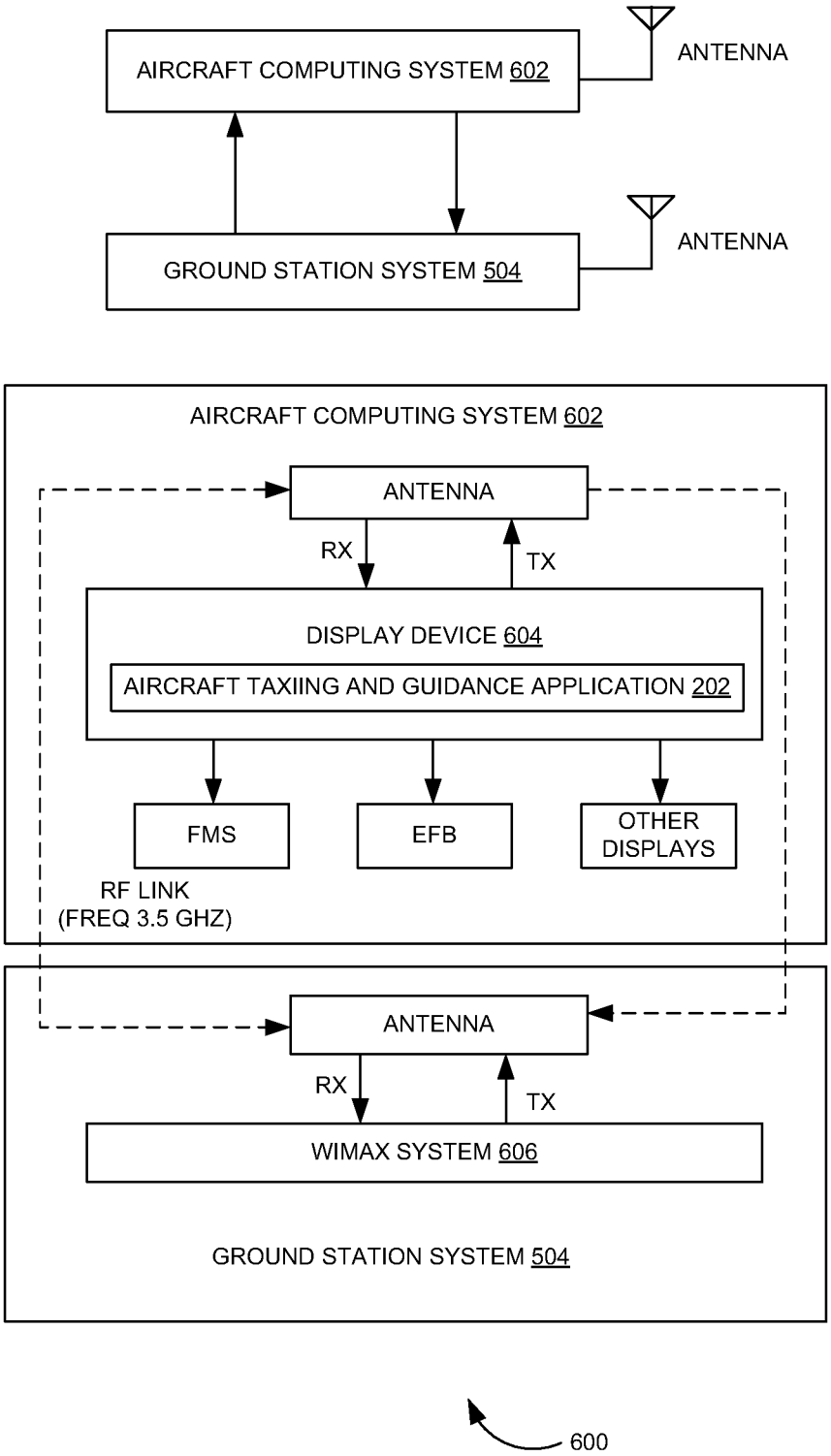
FIG. 6 illustrates a block diagram including major components of the aircraft taxiing and guidance system shown in FIG. 5, according to one embodiment.

FIG. 6 illustrates a block diagram 600 including major components of the aircraft taxiing and guidance system 500 shown in FIG. 5, according to one embodiment. As illustrated, the ground station system 504 is communicatively linked to an aircraft computing system 602 of the aircraft 502 via a Wimax system 606. The aircraft computing system 602 includes a display device 604 with an integrated modem. The display device 604 is an interactive display and displays the aircraft taxiing and guidance application 202 upon establishing the communication link between the ground station system 504 and the aircraft computing system 602.

Further, the display device 604 displays the route map 402 when the gate B2 is selected for parking the aircraft 502. The route map 402 may be also displayed on other non-dedicated displays associated with FMS, EFB, and the like. Based on the displayed route map 402, the pilot taxies and guides the aircraft 502 to the selected gate B2. The position of the aircraft 502 may be obtained using a global positioning system (GPS). Further, the aircraft taxiing and guidance system 500 may be configured with a feedback mechanism in order to generate warnings to the pilot via messages on the display device 604. This informs the pilot of possible deviation from the track thereby enabling accuracy in the path followed to reach the selected gate B2.

Figure 7:
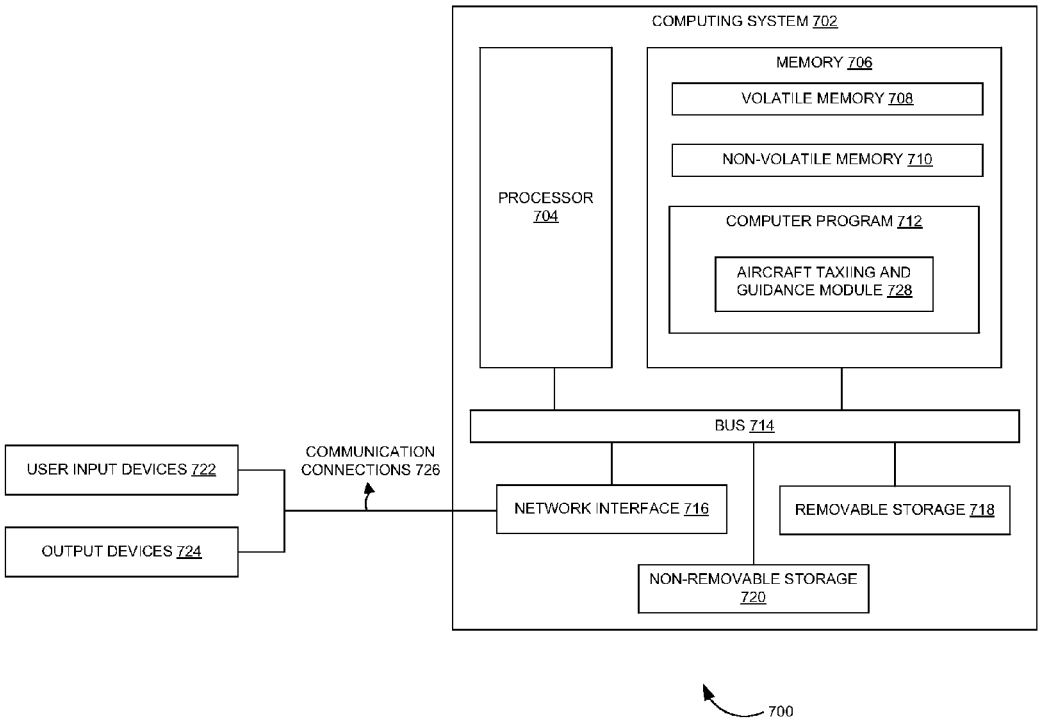
FIG. 7 shows an example of a suitable computing system environment for implementing embodiments of the present subject matter.

FIG. 7 shows an example of a suitable computing system environment 700 for implementing embodiments of the present subject matter. FIG. 7 and the following discussion are intended to provide a brief, general description of a suitable computing environment in which certain embodiments of the inventive concepts contained herein may be implemented.

A general computing system 702, in the form of a personal computer or a mobile device may include a processor 704, memory 706, a removable storage 718, and a non-removable storage 720. The computing system 702 additionally includes a bus 714 and a network interface 716. The computing system 702 may include or have access to the computing system environment 700 that includes one or more user input devices 722, one or more output devices 724, and one or more communication connections 726 such as a network interface card or a universal serial bus connection.

The one or more user input devices 722 may be a digitizer screen and a stylus, trackball, keyboard, keypad, mouse, and the like. The one or more output devices 724 may be a display device of the personal computer, the mobile device, an aircraft cockpit system, an aircraft navigation system, and the like. The communication connections 726 may include a local area network, a wide area network, and/or other networks.

The memory 706 may include volatile memory 708 and non-volatile memory 710. A variety of computer-readable storage media may be stored in and accessed from the memory elements of the computing system 702, such as the volatile memory 708 and the non-volatile memory 710, the removable storage 718 and the non-removable storage 720. Computer memory elements may include any suitable memory device(s) for storing data and machine-readable instructions, such as read only memory, random access memory, erasable programmable read only memory, electrically erasable programmable read only memory, hard drive, removable media drive for handling compact disks, digital video disks, diskettes, magnetic tape cartridges, memory cards, Memory Sticks™, and the like.

The processor 704, as used herein, means any type of computational circuit, such as, but not limited to, a microprocessor, a microcontroller, a complex instruction set computing microprocessor, a reduced instruction set computing microprocessor, a very long instruction word microprocessor, an explicitly parallel instruction computing microprocessor, a graphics processor, a digital signal processor, or any other type of processing circuit. The processor 704 may also include embedded controllers, such as generic or programmable logic devices or arrays, application specific integrated circuits, single-chip computers, smart cards, and the like.

Embodiments of the present subject matter may be implemented in conjunction with program modules, including functions, procedures, data structures, and application programs, for performing tasks, or defining abstract data types or low-level hardware contexts. Machine-readable instructions stored on any of the above-mentioned storage media may be executable by the processor 704 of the computing system 702. For example, a computer program 712 may include machine-readable instructions capable of taxiing and guiding an aircraft using a communication network, according to the teachings and herein described embodiments of the present subject matter. In one embodiment, the computer program 712 may be included on a compact disk-read only memory (CD-ROM) and loaded from the CD-ROM to a hard drive in the non-volatile memory 710. The machine-readable instructions may cause the computing system 702 to encode according to the various embodiments of the present subject matter.

As shown, the computer program 712 includes an aircraft taxiing and guidance module 728. For example, the aircraft taxiing and guidance module 728 may be in the form of instructions stored on a non-transitory computer-readable storage medium. The non-transitory computer-readable storage medium having the instructions that, when executed by the computing system 702, may cause the computing system 702 to perform the one or more methods described in FIGS. 1 through 7.

In various embodiments, the methods and systems described in FIGS. 1 through 7 enables a pilot to view actual gate nomenclature and location, and to select a desired gate on an interactive display. The interactive display also shows actual path and an alternate path to the pilot to be taken to reach the selected gate for parking the aircraft. In such a scenario, a ground marshaller is not required to taxi the aircraft. The above-described methods and systems eliminate use of an airport database present in earlier and current computing systems with the use of Wimax technology and hence database updation and maintenance may be avoided. Further, the above-described methods and systems provide indication to the pilot that a particular gate is busy by placing the selected gate in a lock mode.

Although the present embodiments have been described with reference to specific example embodiments, it will be evident that various modifications and changes may be made to these embodiments without departing from the broader spirit and scope of the various embodiments. Furthermore, the various devices, modules, analyzers, generators, and the like described herein may be enabled and operated using hardware circuitry, for example, complementary metal oxide semiconductor based logic circuitry, firmware, software and/or any combination of hardware, firmware, and/or software embodied in a machine readable medium. For example, the various electrical structure and methods may be embodied using transistors, logic gates, and electrical circuits, such as application specific integrated circuit.

What is claimed is:

1. A method of aircraft taxiing and guidance, comprising:

establishing a communication link between an aircraft computing system and a ground station system using a communication network provided by the ground station system after landing of an aircraft;

displaying an aircraft taxi selection and guidance application residing in the aircraft computing system on a display device in an aircraft cockpit upon establishing the communication link;

displaying one or more pilot selectable taxiing and ground services upon selecting the aircraft taxi selection and guidance application;

selecting one of the displayed pilot selectable taxiing and ground services by a pilot of the aircraft;

displaying information associated with the selected one of the displayed pilot selectable taxiing and ground services on the display device using ground station data residing in the ground station system via the communication link; and taxiing and guiding the aircraft to a parking position by the pilot using the displayed information.

2. The method of claim 1, wherein the aircraft computing system is selected from the group consisting of a mobile computing system, an aircraft cockpit system, and an aircraft navigation system.

3. The method of claim 1, wherein the communication network comprises WiMax.

4. The method of claim 1, wherein establishing the communication link between the aircraft computing system and the ground station system, comprises:

establishing the communication link between the aircraft computing system and the ground station system using the communication network provided by the ground station system by an aircraft after landing and when approaching substantially near a landing position.

5. The method of claim 1, wherein the one or more pilot selectable taxiing and ground services are selected from the group consisting of taxiway services, connecting flight services, aircraft logbook services, pilot request services, and airport terminal information services.

6. A non-transitory computer-readable storage medium for aircraft taxiing and guidance having instructions that, when executed by a computing device, cause the computing device to perform a method comprising:

establishing a communication link between an aircraft computing system and a ground station system using a communication network provided by the ground station system;

displaying an aircraft taxi selection and guidance application residing in the aircraft computing system on a display device in an aircraft cockpit upon establishing the communication link after landing of an aircraft;

displaying one or more pilot selectable taxiing and ground services upon selecting the aircraft taxi selection and guidance application;

selecting one of the displayed pilot selectable taxiing and ground services by a pilot in the aircraft;

displaying information associated with the selected one of the displayed pilot selectable taxiing and ground services on the display device using ground station data residing in the ground station system via the communication link; and taxiing and guiding the aircraft to a parking position by the pilot using the displayed information.

7. The non-transitory computer-readable storage medium of claim 6, wherein the aircraft computing system is selected from the group consisting of a mobile computing system, an aircraft cockpit system, and an aircraft navigation system.

8. The non-transitory computer-readable storage medium of claim 6, wherein the communication network comprises WiMax.

9. The non-transitory computer-readable storage medium of claim 6, wherein establishing the communication link between the aircraft computing system and the ground station system, comprises:

establishing the communication link between the aircraft computing system and the ground station system using the communication network provided by the ground station system by an aircraft after landing and when approaching substantially near a landing position.

10. The non-transitory computer-readable storage medium of claim 6, wherein the one or more pilot selectable taxiing and ground services are selected from the group consisting of taxiway services, connecting flight services, aircraft logbook services, pilot request services, and airport terminal information services.

11. A system for aircraft taxiing and guidance, comprising:

a processor;

memory coupled to the processor, wherein the memory includes an aircraft taxiing and guidance module;

an aircraft computing system including a display device;

a ground station system; and a communication network for establishing a communication link between the aircraft computing system and the ground station system after landing of an aircraft, wherein the communication network is provided by the ground station system, wherein the aircraft taxiing and guidance module has instructions capable of displaying an aircraft taxi selection and guidance application residing in the aircraft computing system on the display device upon establishing the communication link, wherein the display device displays one or more pilot selectable taxiing and ground services upon selecting the aircraft taxi selection and guidance application, wherein the display device displays information associated with a selected one of the displayed pilot selectable taxiing and ground services using ground station data residing in the ground station system via the communication link, and wherein the displayed information is used by a pilot for taxiing and guiding the aircraft to a parking position.

12. The system of claim 11, wherein the aircraft computing system is selected from the group consisting of a mobile computing system, an aircraft cockpit system, and an aircraft navigation system.

13. The system of claim 11, wherein the one or more pilot selectable taxiing and ground services are selected from the group consisting of taxiway services, connecting flight services, aircraft logbook services, pilot request services, and airport terminal information services.

* * * * *